United States Patent [19]

Leone

[11] Patent Number: 5,025,947

[45] Date of Patent: Jun. 25, 1991

[54] SINGLE-DOSE BEVERAGE CUP AND RECTANGULAR CROSS-SECTION STRAW ASSEMBLY

[76] Inventor: Marcello Leone, Via. M. Celentano, 87 - 70121 Bari, Italy

[21] Appl. No.: 427,711

[22] Filed: Oct. 27, 1989

[30] Foreign Application Priority Data

Oct. 28, 1988 [IT] Italy ..... 22461 A/88

[51] Int. Cl.[5] ..... B65D 41/50

[52] U.S. Cl. ..... 220/90.2; 220/229; 229/906.1; 229/DIG. 8

[58] Field of Search ..... 220/90.2, 90.4, 229; 229/103.1, 906.1, DIG. 8; 239/33

[56] References Cited

U.S. PATENT DOCUMENTS

| | | | |
|---|---|---|---|
| Re. 31,650 | 8/1984 | Serritella | 229/906.1 |
| 1,603,024 | 10/1926 | Childs | 229/DIG. 8 |
| 2,018,861 | 10/1935 | Mertz | 229/DIG. 8 |
| 2,531,855 | 11/1950 | Loptson | 239/33 |
| 3,171,580 | 3/1965 | Davis et al. | 229/906.1 |
| 3,406,868 | 10/1968 | Rogers | 220/90.2 |
| 3,780,944 | 12/1973 | Zubalik | 239/33 |
| 3,822,030 | 7/1974 | Tanzer | 220/90.2 |
| 3,874,554 | 4/1975 | Chang | 220/229 |
| 4,037,754 | 7/1977 | Wilhelmi et al. | 220/229 |
| 4,356,955 | 11/1982 | Schmit | 220/90.2 |
| 4,438,865 | 3/1984 | Scattaregia | 220/90.2 |
| 4,481,977 | 11/1984 | Maldavs | 220/229 |
| 4,627,537 | 12/1986 | Rogers | 229/906.1 |
| 4,726,518 | 2/1988 | Martina et al. | 239/33 |

*Primary Examiner*—Stephen Marcus
*Assistant Examiner*—S. Castellano
*Attorney, Agent, or Firm*—Bucknam and Archer

[57] ABSTRACT

A beverage cup has a cover or a wall therethrough a substantially rectangular cross-section straw can be threaded in a tight manner, the cover or wall being formed with breakage-facilitating weakened lines and the straw including a plurality of longitudinal suction ducts.

1 Claim, 4 Drawing Sheets

SINGLE-DOSE BEVERAGE CUP AND RECTANGULAR CROSS-SECTION STRAW ASSEMBLY

BACKGROUND OF THE INVENTION

The present invention relates to a single-dose beverage or drink cup, having a cover or wall so designed as to be tightly engaged therethrough by a rectangular cross-section straw.

As is known a lot of beverages (such as soft drinks, tea, coffee, milk-shake and the like) are currently packaged in substantially single-dose packages of essentially parallelepipedal or cup shape.

The thus packaged beverages are generally sucked from the cup by means of an elongated straw which must be threaded through the top wall or cover of the cup: for facilitating the straw threading, the cup top wall or cover is usually formed with a small reduced thickness portion, or a portion defined by a perimetrical reduced thickness line.

This reduced portion is specifically designed for the introduction of conventional suction straws, that is round cross-section straws.

For facilitating the suction of the beverage from the cup, specifically designed straws are moreover used which substantially comprise a plurality of adjoining longitudinal ducts and have, in plan, an elongated rectangular shape.

These straws, however, can not be efficiently used for sucking beverages packaged in the above mentioned cups or vessels.

SUMMARY OF THE INVENTION

Thus, the aim of the present invention is to overcome the above mentioned drawback, by providing a single dose cup or vessel for beverages which can be easily penetrated by one end of a suction straw of the multiple suction duct type.

Within the scope of that aim, a main object of the present invention is to provide such a beverage cup which has a substantially conventional shape, that is a tapering cup shape or a parallelepipedal shape.

Another object of the present invention is to provide such a beverage cup or vessel which can be made by conventional making machines.

According to one aspect of the present invention, the above mentioned aim and objects, as well as yet other objects, which will become more apparent hereinafter, are achieved by a single-dose cup characterized in that said cup comprises a top wall or cover including weakened pre-breakage lines related to the longitudinal axis and cross-section of a suction straw of rectangular cross-section and including a plurality of longitudinal suction ducts.

BRIEF DESCRIPTION OF THE DRAWINGS

Further characteristics and advantages of the invention will become more apparent from the following detailed description of a preferred embodiment thereof, which is illustrated, by way of an indicative but not limitative example, in the figures of the accompanying drawings, where.

DESCRIPTION OF THE PREFERRED EMBODIMENT

Figure 1:
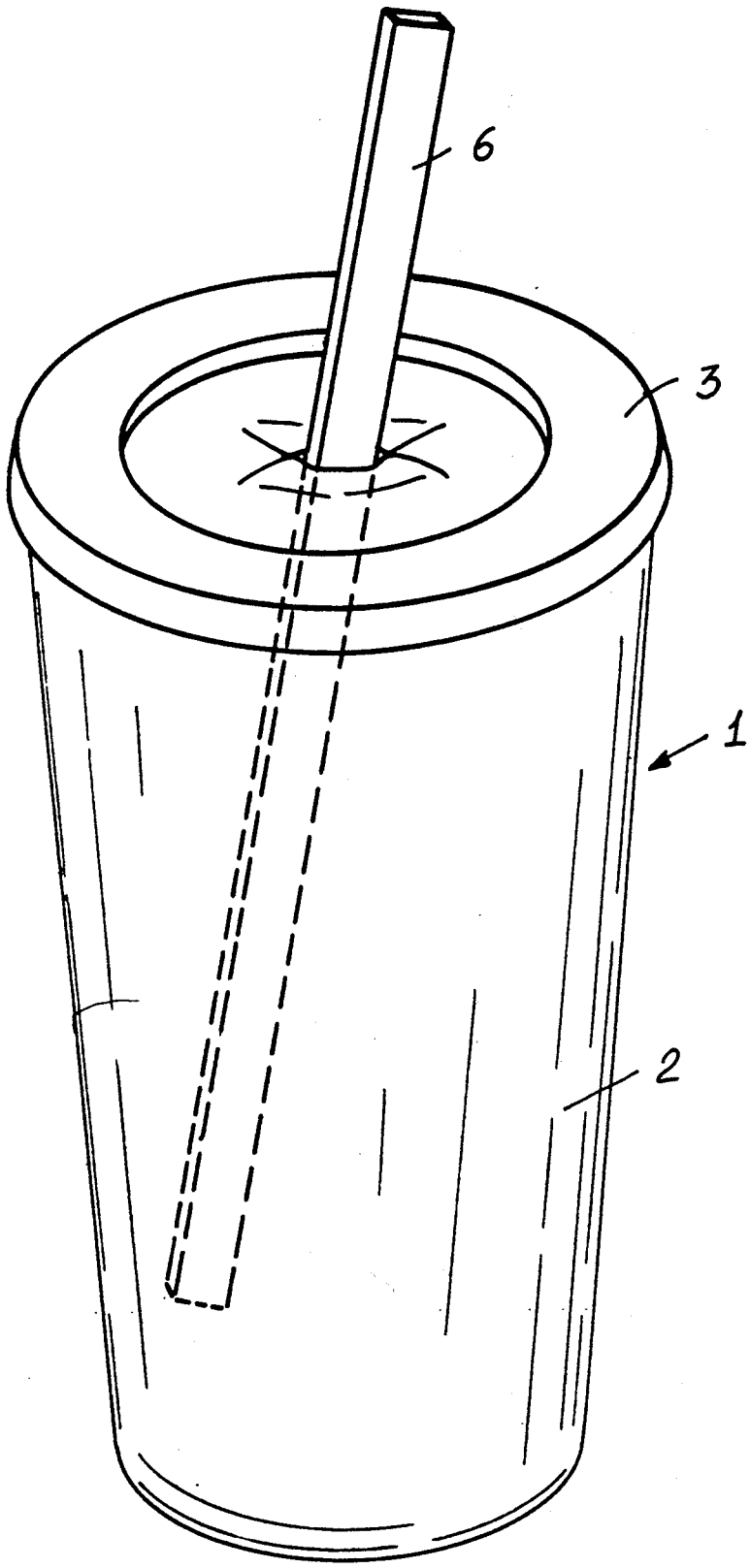
FIG. 1 is a perspective view illustrating a tapering cup for beverages according to the present invention.
Figure 2:
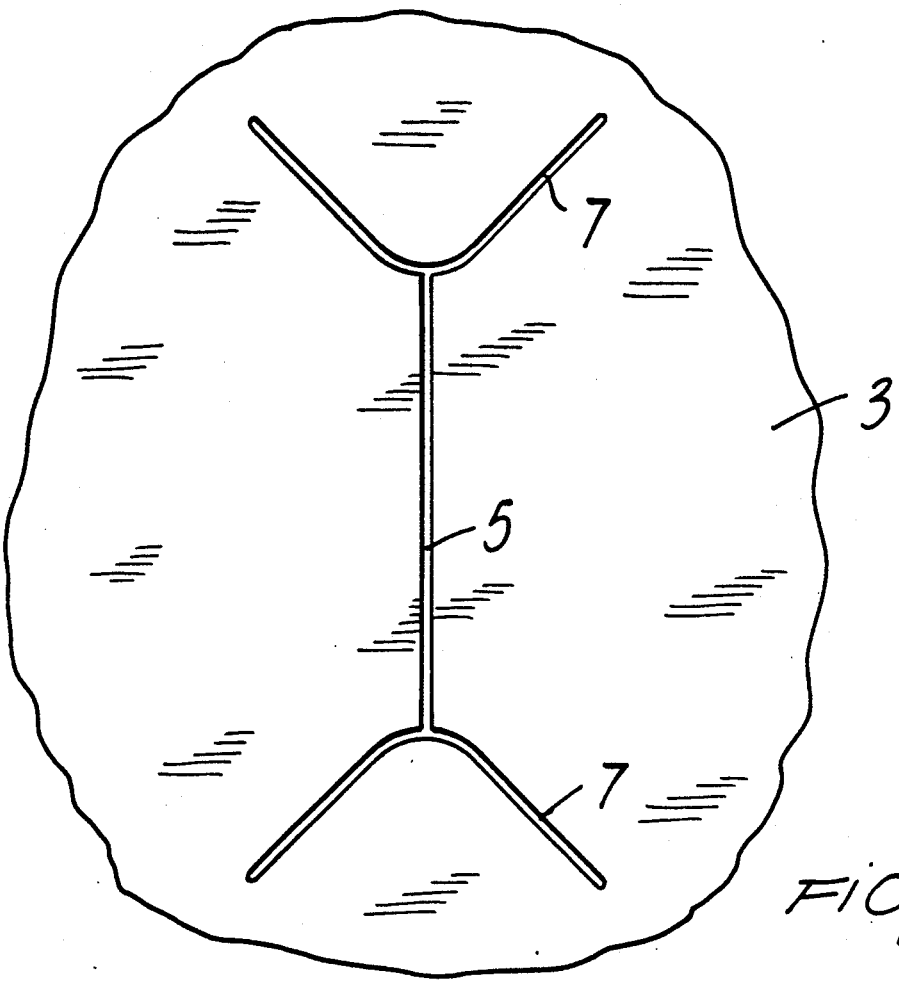
FIG. 2 shows on an enlarged scale a broken away portion of a cup cover provided with a breakage facilitating weakened line formed on the top cover of the cup.
Figure 3:
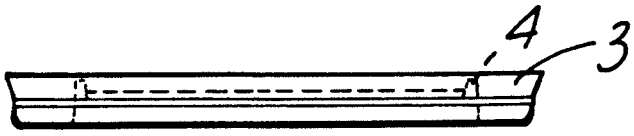
FIGS. 3 and 4 are respectively an elevation view and a top plan view illustrating a preferred embodiment of said cover.
Figure 4:
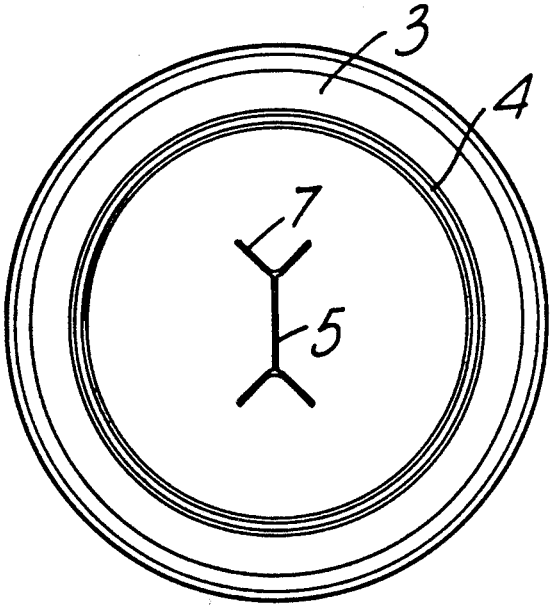

With reference to the figures of the accompanying drawings, the single-dose beverage cup according to the present invention, which has been indicated overally at the reference number 1, comprises a frustum of cone shaped body 2 which, at the top thereof, is tightly closed by a circular cover member 3.

This cover is preferably provided with stiffening ribs 4 and is made from any suitable plastic or laminate material, which also forms the cup body 2.

On the cover there is diametrically formed a breakage facilitating diametrical weakened rectilinear line 5, having a length related to the width of a multiple suction duct straw 6, of substantially known type.

At the ends of the mentioned line 5 there are formed further pre-breakage line pairs 7, which have a substantially dihedral arrangement, that is each pair of lines 7 converge to a respective end of the line 5.

Figure 5:
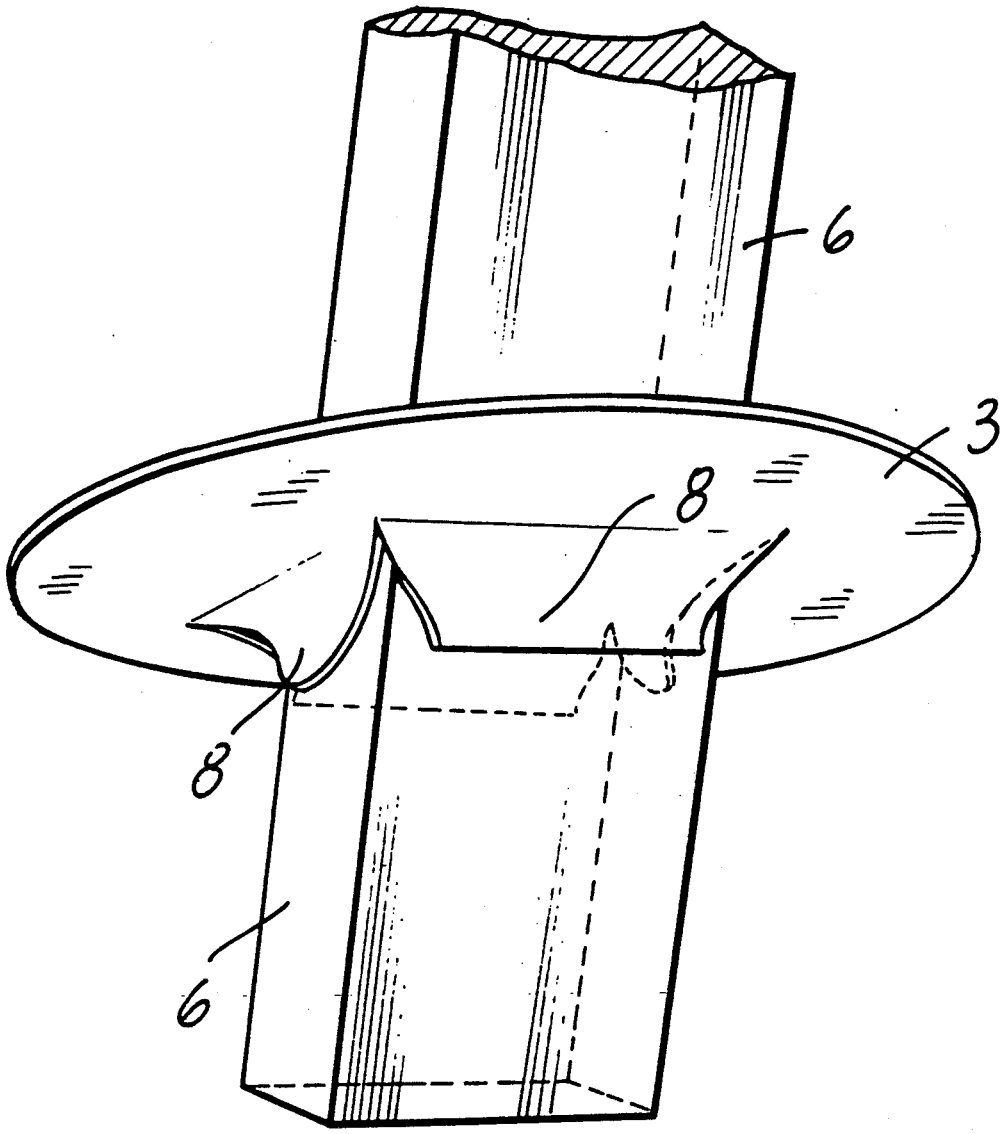
FIG. 5 is a schematic view illustrating the cup cover with a portion of a suction straw threaded therein.

The pre-breakage line arrangement, in particular, has been so designed as to allow for the straw to be easily introduced into the cup, while firmly restraining the introduced straw owing to the provision of the edge portions 8, as is clearly shown in FIG. 5.

In this connection, it should be pointed out that the mentioned breakage facilitating lines 5 and 7 exclusively affect the surface portion of the cover or top wall, thereby a perfect tightness of the cup is assured.

Figure 6:
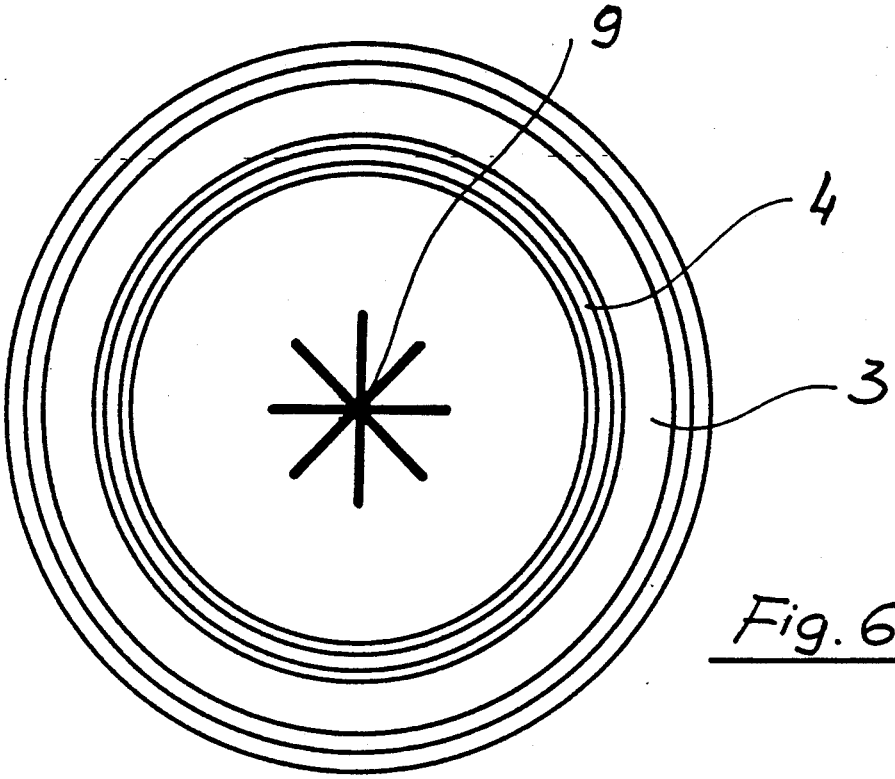
FIGS. 6 and 7 are further top plan views illustrating other embodiments of covers which can be fitted to the subject cup and provided with different weakened line arrangements.
Figure 7:
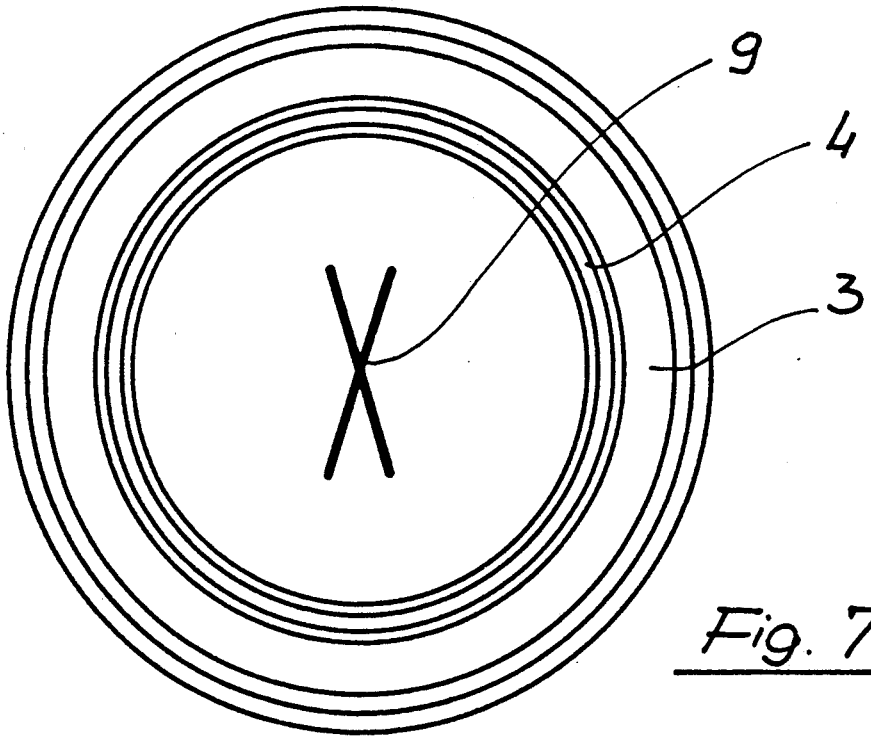

According to a further arrangement, the mentioned lines, as shown in FIGS. 6 and 7, can also extend radially from a central point 9 of the cover or top wall.

While the invention has been disclosed and illustrated with reference to preferred embodiments thereof, it should be apparent that the disclosed embodiments are susceptible to several modifications and variations all of which will come within the spirit and scope of the appended claims.

I claim:

1. A single-dose cup of frustoconical shape for beverages, comprising a cup body and a ribbed circular cover, to be perforated by a rectangular cross-section multiple suction duct suction straw, said cover being formed with a breakage-facilitating surface weakened line arrangement including a diametrical weakened rectilinear line having first and second ends and end weakened line pairs substantially converging to said first and second ends of said diametrical weakened rectilinear line.

* * * * *